US007125136B1

(12) United States Patent
Dedic et al.

(10) Patent No.: US 7,125,136 B1
(45) Date of Patent: Oct. 24, 2006

(54) HOLLOW DOORFRAME INCLUDING ELECTROLUMINESCENT ILLUMINATION SYSTEM

(75) Inventors: David J Dedic, Mason City, IA (US); Thomas L Rattay, Mason City, IA (US)

(73) Assignee: Assa Abloy Door Group, LLC, New Haven, CT (US)

( * ) Notice: Subject to any disclaimer, the term of this patent is extended or adjusted under 35 U.S.C. 154(b) by 195 days.

(21) Appl. No.: 10/755,733

(22) Filed: Jan. 12, 2004

(51) Int. Cl.

| | |
|---|---|
| ***F21S 8/02*** | (2006.01) |
| ***G09F 7/08*** | (2006.01) |
| ***E06B 1/04*** | (2006.01) |
| ***E04C 2/54*** | (2006.01) |

(52) U.S. Cl. ..... 362/152; 362/84; 40/606.07; 52/204.1; 52/656.4

(58) Field of Classification Search ..... 362/84, 362/470, 147, 152; 40/606.07; 52/204.1, 52/656.7

See application file for complete search history.

(56) References Cited

U.S. PATENT DOCUMENTS

| | | | | |
|---|---|---|---|---|
| 2,733,367 | A * | 1/1956 | Gillson | 40/544 |
| 4,365,232 | A * | 12/1982 | Miller | 340/945 |
| 4,801,928 | A | 1/1989 | Minter | |
| 5,019,748 | A | 5/1991 | Appelberg | |
| 5,499,170 | A | 3/1996 | Gagne | |
| 5,775,016 | A * | 7/1998 | Chien | 362/570 |
| 5,961,072 | A | 10/1999 | Bodle | |
| 6,025,773 | A * | 2/2000 | Bresnan | 116/205 |
| 6,058,635 | A * | 5/2000 | Morris | 40/570 |
| 6,099,136 | A * | 8/2000 | Becnel | 362/34 |
| 6,276,634 | B1 * | 8/2001 | Bodle | 362/84 |
| 6,472,994 | B1 | 10/2002 | Tator | |
| 6,527,401 | B1 | 3/2003 | Chu | |
| 6,785,992 | B1 * | 9/2004 | Chiarucci | 40/596 |
| 2001/0013185 | A1 * | 8/2001 | Chien | 40/544 |
| 2003/0189823 | A1 * | 10/2003 | George et al. | 362/84 |
| 2003/0231485 | A1 * | 12/2003 | Chien | 362/84 |
| 2004/0016186 | A1 * | 1/2004 | Iarussi | 362/125 |

* cited by examiner

*Primary Examiner*—Thomas M. Sember
*Assistant Examiner*—Ismael Negron
(74) *Attorney, Agent, or Firm*—DeLio & Peterson, LLC; Robert Curcio

(57) ABSTRACT

A contiguous emergency exit path lighting system that includes the peripheral lighting of a hollow doorframe at an egress point using a set of electroluminescent illuminators integrally formed within or upon the doorframe, an electrical bypass doorframe to reroute wiring around doorways that are not points of egress, electroluminescent illuminator strips mountable on walls, floors, and other pathway surfaces, and flush mount exit signage on the egress door to enhance visibility in high smoke and high heat applications. An integrally formed U-shaped channel within the egress doorframe secures a transparent or translucent raceway tube that encloses the electroluminescent strips.

16 Claims, 4 Drawing Sheets

HOLLOW DOORFRAME INCLUDING ELECTROLUMINESCENT ILLUMINATION SYSTEM

BACKGROUND OF THE INVENTION

1. Field of the Invention

This invention relates to emergency lighting, typically for the interior of buildings and large vehicles, and specifically for lighting around and directed to points of egress. More specifically, the invention relates to a contiguous emergency exit path lighting system that includes the lighting of a hollow doorframe at an egress point, an electrical bypass doorframe for doorways that are not points of egress, and flush mount exit signage to enhance visibility in high smoke and high heat applications.

2. Description of Related Art

There continually exists a need to provide illuminated egress routes for people who do not know the way, or for those in a panic situation who fail to recognize the closest and most efficient exit pathway. Many systems exist to provide guidance for persons in buildings, vehicles, or other closed spaces to escape routes during emergencies or non-emergency situations. To safely evacuate the occupants, the corridors are usually provided with illuminated EXIT signs that are placed in separate locations above the exit doors. Illuminated EXIT signs are required by law in most public buildings and in vehicles used for public transport. Conventional signs are usually placed above doors and other points of egress to ensure visibility and protect from damage. However, in many structures, the exit indicators may be obscured by smoke or heated air from fire. Since smoke and heated air rise, an EXIT sign above an egress point is more likely to be obscured than one closer to the floor. In fact, it is common in modern jet aircraft to have an emergency low-level lighting system on the floorboards usually consisting of a plastic tube with miniature incandescent lamps retained within the tube at intervals for directing traffic to exit routes.

Generally, incandescent or fluorescent lighting in buildings routinely performs the illumination of areas of passage for safety routes. However, these conventional illumination technologies require fragile bulbs, and provide for non-uniform illumination and excess heat. Extremely thin electroluminescent or photo-luminescent strips or panels have recently been introduced as lighting elements for exits, capable of following the curvature of the walls or floorboards to indicate the point of egress. The electroluminescent strips provide for less power consumption and are more robust than the incandescent or fluorescent lighting fixtures.

The more visible the point of egress becomes during an emergency, the more likely it is that people will utilize the exit pathway during this time of need. Illuminating with directional lighting strips on walls and floorboards is becoming accepted in the art, and expected by the public. In U.S. Pat. No. 6,472,994 issued to Tator on Oct. 29, 2002, entitled "EMERGENCY GUIDANCE SYSTEM," a line of illuminated, electrically powered exit indicators is mounted on a tape-like adhesive surface, which can be attachable to walls to direct traffic flow toward the point of egress. However, the light strips do not interconnect with the EXIT signs located on or about the doorway, nor do they allow for bypassing doorways that are not points of egress.

In U.S. Pat. No. 6,058,635 issued to Morris on May 9, 2000, entitled "DOOR FRAME WITH INTEGRATED EXIT SIGNAGE," a metal door frame is constructed with three apertures, one on the overhead lintel and one on each of the two side panels for EXIT signs. The doorframe construction includes a hollow, inverted U-shaped frame member to accommodate electrical wiring. The EXIT signs are integrated through the electrical wiring and made to accommodate incandescent bulbs. They are not made to interconnect with electroluminescence lighting strips. Nor do the EXIT signs illuminate the complete doorframe periphery.

To date, doorframe manufacturers have not provided any means to accommodate the interconnection of strip lighting on walls and floorboards with the illumination of the egress point, where the illuminators are integral within a doorframe. A doorframe illuminated about its periphery with associated EXIT signs would provide a more visible exit pathway during times of emergency, panic, or any other time when vision can be obscured. Moreover, the doorframe with integral illuminators would be easier to install, and provide a more aesthetically pleasing appearance.

Bearing in mind the problems and deficiencies of the prior art, it is therefore an object of the present invention to provide an emergency path lighting system for illuminating a pathway to a point of egress that includes illuminating the periphery of a doorframe at the point of egress.

It is another object of the present invention to provide a doorframe with integrally formed electroluminescent illuminators to outline available points of egress.

A further object of the invention is to provide a lighting system that continues to illuminate a pathway to points of egress when the pathway crosses doorways that are not points of egress.

It is yet another object of the present invention to provide an illuminated exit sign built into an exit door for low level visibility during times of smoke or high heat conditions.

Still other objects and advantages of the invention will in part be obvious and will in part be apparent from the specification.

SUMMARY OF THE INVENTION

The above and other objects, which will be apparent to those skilled in the art, are achieved in the present invention, which is directed to in a first aspect to an egress doorframe for illuminating a point of egress, comprising at least three frame members including two side panels and an overhead lintel, the side panels separated by the overhead lintel, each of the frame members formed of a hollow construction, having a formed interior portion for receiving a door, an open exterior portion for attaching to a support structure, outwardly facing first and second side faces, and defining a maximum outer periphery, and an outwardly open electroluminescent strip secured to the first side face within the maximum outer periphery, such that when the electroluminescent strip is activated by a power source, the egress doorframe is lighted about the two side panels and the overhead lintel. The egress doorframe further comprises a channel located on the first side face. The channel may be U-shaped and integrally formed with the first side face, or U-shaped and secured to the first side face. The electroluminescent strip is placed within a raceway tube having at least a transparent or translucent front surface, the raceway tube being secured to the first side face. The raceway tube comprises a substantially rectangular shape having a front portion, a back portion, and two side portions, the raceway tube being substantially uniform in thickness on the front and back portions, having a thickness substantially smaller than the uniform thickness on one of the side portions forming a hinge, and having an overlapping, interlocking clamp on the other of the side portions, or alternatively a two-part raceway having overlapping, interlocking clamps on both side portions. The electroluminescent strip is placed within the raceway tube and has at least a transparent or translucent front surface, the raceway tube fitted within and secured to the channel. The egress doorframe further includes a junction box securable to the doorframe, the junction box providing for electrical connection to the power source for the electroluminescent strips within the frame members. The egress doorframe also includes an aperture within the doorframe where the junction box attaches to allow electrical connection from a connector in the junction box cover through the doorframe to the electroluminescent strips. A door may be attached to the egress doorframe by a hinged connector, the door having a recess for flush mounting an EXIT sign. The hinged connector may have at least one aperture for electrical wiring to and from the EXIT sign through the door and the recess; and a corresponding aperture in the doorframe to receive the wiring from the hinged connector.

In a second aspect, the present invention is directed to a bypass doorframe for rerouting wiring, the bypass doorframe comprising at least three frame members including two side panels and an overhead lintel, each formed of a hollow construction and having a formed portion for receiving a door, a formed portion for attaching to a support structure, outwardly facing first and second side faces, and side channel raceways inside the frame members for receiving electrical wiring, the side channel raceways carrying the electrical wiring in from an aperture through one of the side panels through the overhead lintel and out an aperture of the other of the side panels. The bypass doorframe further includes at least one elongated, flat metal segment attached to the frame members for enclosing the side channel raceways within the hollow construction of the bypass doorframe.

In a third aspect, the present invention is directed to a lighting system for illuminating a point of egress comprising: an egress doorframe including egress side frame members and an egress overhead lintel, each having an outwardly facing U-shaped channel for mounting electroluminescent strips about the periphery of the egress doorframe such that when the electroluminescent strip in the U-shaped channel is activated by a power source, the egress doorframe is lighted peripherally about the frame members and the egress overhead lintel; a plurality of electroluminescent strips within a first set of transparent or translucent raceway tube segments attachable to structures leading to the egress doorframe; and a bypass doorframe including bypass side frame members and a bypass overhead lintel, each having metal channel raceways inside for receiving electrical wiring, the channel raceways carrying the electrical wiring in from an aperture through one of the bypass frame members through the bypass overhead lintel and out an aperture of another of the bypass frame members; such that when the power source is applied, the electroluminescent strips illuminate a path on the structures leading to the egress doorframe, the egress doorframe periphery is illuminated, and doorways not providing egress are configured with the bypass doorframes to maintain electrical continuity for the electroluminescent strips on each side of the doorways. The lighting system further includes a second set of transparent or translucent raceway tube segments for insertion within the outwardly facing U-shaped channel, the second set of raceway tube segments having the electroluminescent strips secured therein.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–14 of the drawings in which like numerals refer to like features of the invention.

The invention is directed to illuminating a point of egress using electroluminescent technology. The lighting system is intended to augment EXIT signage that typically is placed above points of egress. The proposed lighting system includes three main components: a) an egress doorframe with integrally formed illuminators that outline available exits, which are generally used in public places during emergencies; b) raceways of electroluminescent strips for illuminating the exit pathway to the points of egress; and c) a bypass doorframe for continuing the electrical connections of the electroluminescent strips around doorways that are not points of egress. Additionally, a flush, low level EXIT sign located in the lower face of an exit door may be used in conjunction with the lighting system to enhance visibility during smoke and high heat conditions, which generally contribute to obscured vision at heights above the escape route.

The electroluminescent strips are illuminators that include electroluminescent material preferably encased in a transparent or translucent electrically insulating material. The strips are typically powered with a 200 volt, 400 Hertz AC signal from an inverter. The inverter selected would be adaptable for any number of power sources. For example, inverter designs make it possible for the illuminators to activate when connected to a power source of 12 volts DC, 24 volts DC, or 110 to 120 volts AC. This allows the illuminators to run on power from an electrical grid, a portable generator, or under the necessary circumstances, a battery.

Figure 1:
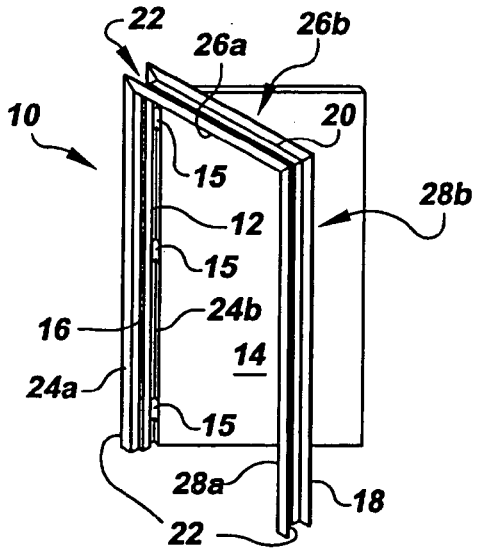
FIG. 1 depicts the egress doorframe with an attached door.
Figure 2:
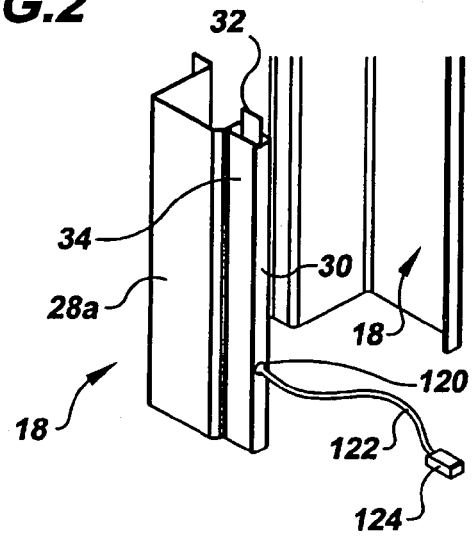
FIG. 2 depicts a detailed view of a portion of one of the frame members of the egress doorframe of FIG. 1, exposing a side face with a U-shaped channel and an inserted illuminator.

Referring to FIGS. 1 and 2, a preferred embodiment of the egress doorframe for peripherally illuminating a point of egress is disclosed. FIG. 1 depicts the egress doorframe with an attached door. The egress doorframe 10 is formed of a conventional hollow construction, having a formed interior portion 12 for receiving a door 14. The hollow egress doorframe has a generally U-shaped configuration including at least three frame members; two side panels 16, 18 and an overhead lintel 20. The overhead lintel separates the two side panels. Each frame member has an open exterior portion 22 for attachment of the egress doorframe to existing supporting structure (not shown). The frame members also include outwardly facing side faces 24*a–b*, 26*a–b*, 28*a–b*. Side faces 24*a*, 26*a* and 28*a* are shown outwardly facing towards the illuminated path, while side faces 24*b*, 26*b* and 28*b* face the opposite direction on the other side of the egress doorframe.

FIG. 2 depicts a detailed view of a portion of side panel 18 of the egress doorframe, exposing side face 28*a*. This depiction is also representative of side face 24*a* on side panel 16 and side face 26*a* on overhead lintel 20, with the possible exception of an aperture for electrical wiring to traverse into and out of the overhead lintel. An outwardly facing U-shaped channel 30 is shown as part of the side face. Preferably, this U-shaped channel is integrally formed from the side face, as depicted in FIG. 2. The U-shaped channel 30 is designed with an appropriate width to allow for an electroluminescent strip 32 to be placed and secured therein. The electroluminescent strip may be secured to a raceway tube 34 by an adhesive fastener, a mechanical fastener, or a friction fit. The U-shaped channel in each frame member allows the electroluminescent strip to be recessed in the front faces of each frame member continuously around the egress doorframe, such that when power is applied to the electroluminescent strips, the egress doorframe is illuminated contiguously about or within its maximum periphery. As further depicted in FIG. 2, preferably the electroluminescent strip 32 is secured to the raceway tube 34, which may then be secured to the U-shaped channel 30 by an adhesive fastener, a mechanical fastener, or a friction fit. Mechanical fasteners include screws, nuts and bolts, spot welding, clamps, and the like. Adhesive fasteners include any adhesive compatible with adhering to metal doorframes and clear or semi-clear high impact plastic or PVC raceway tubes. The raceway tube 34 is preferably transparent or translucent at least on the entire front surface or at least a significant portion thereof. As shown, the raceway tube is substantially rectangular in shape, although other shapes that fit within the U-shaped channel are acceptable. Additionally, FIG. 2 depicts an aperture 120 through which the U-shaped channel allows for the electroluminescent strip's electrical wiring 122 to leave the egress doorframe and connect with a power source 124 or another electroluminescent strip (not shown).

Hinges 15 are generally located on one side of the interior portion for mounting the door 14. Generally, emergency exit doors open outwards. Consequently, it is common for the hinges 15 to be located on the doorframe opposite the electroluminescent strip 32, as shown in FIGS. 1 and 2; however, the door may also be placed on the same side as the electroluminescent strip. The door placement does not alter the lighting system design.

As shown in FIGS. 1 and 2, U-shaped channel 30 is integrally formed within each of the side faces at their outside edge opposite the egress doorframe interior portion 12. However, the position of the U-shaped channel may vary across the width of the side face. FIG. 3 depicts a cross-sectional view of two different positions for placement of the U-shaped channel integrally formed with the side faces.

Figure 3A:
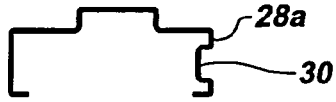
FIGS. 3A–3C depict cross-sectional views of different positions for placement of the U-shaped channel integrally formed with a side panel.
Figure 3B:
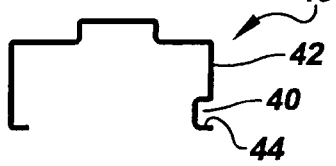
Figure 3C:
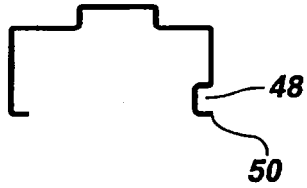

FIG. 3A illustrates the preferred embodiment, deploying U-shaped channel 30 in the side face 28*a*, shown here for illustrative purposes and similar to the other side faces. FIGS. 3B and 3C depict the placement of the U-shaped channel at the extreme outside edge of a side face. In FIG. 3B the U-shaped channel 40 is integrally formed at the outside edge of side face 42 and terminated with a curved segment 44 of the egress doorframe 46, folded back within the U-shaped channel. The U-shaped channel 48 may also terminate in a straight edge 50 as depicted in FIG. 3C. Although only two positions of the U-shaped channel are depicted in the drawings, any doorframe design that positions the U-shaped channel somewhere along the width of the side faces for each frame member is acceptable for the lighting system's integrity and visibility, and within the scope and intent of the present invention.

Figure 4:
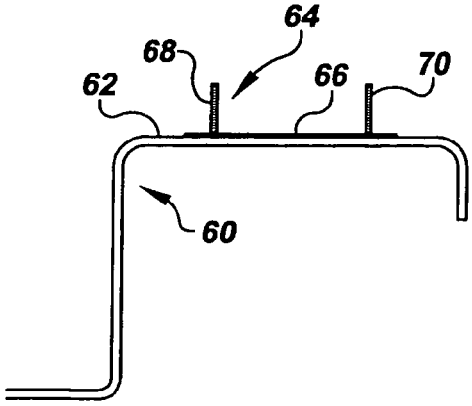
FIG. 4 depicts a cross-sectional view of a portion of an egress doorframe having a flat side face surface with a channel attached thereto.

In another embodiment, the U-shaped channel is not integrally formed with the egress doorframe; rather, it is attached to the flat side face of each frame member. In this embodiment, a channel, a raceway tube, and an electroluminescent strip secured within the channel are no longer recessed within the egress doorframe's side faces. FIG. 4 depicts a cross-sectional view of a portion of an egress doorframe 60 having a flat side face surface 62 with a channel 64 attached thereto. The channel 64 is attached to the side face surface 62 in the direction of the intended illumination. In this embodiment, the channel is shown as a preformed, open-faced structure having a flat back portion 66 for attachment to side face 62, and two support struts 68, 70 for enclosing the raceway tube and electroluminescent strip (not shown). The channel 64 may be formed from one piece or may be constructed of separate pieces of material secured together. For example, each strut may be attached to a flat back panel, which is then attached to the flat surface of the side face. A center position for the channel is depicted; however, the channel may be placed in any position on the egress doorframe side faces that allows for visibility of the electroluminescent strips.

Figure 5:
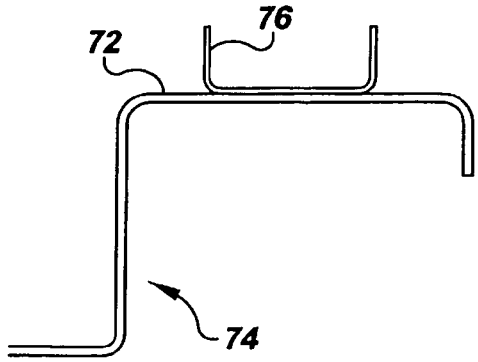
FIG. 5 depicts a cross-sectional view of a portion of an egress doorframe having a U-shaped channel, formed of one-piece construction and secured to the flat surface of a side face of the egress doorframe.

FIG. 5 depicts a cross-sectional view of a portion of an egress doorframe 74 having a U-shaped channel 76, formed of one-piece construction and secured to the flat surface of a side face 72 of the egress doorframe. The U-shaped channel 76 may be attached by adhesive fastener, mechanical fastener, or by a friction fit.

Figure 6:
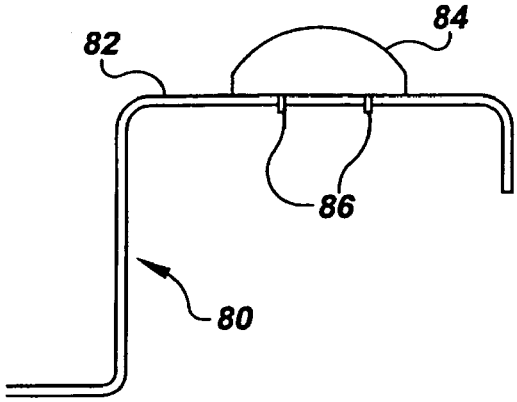
FIG. 6 depicts a cross-sectional view of a portion of an egress doorframe with a flat surface side face and raceway tube attached thereto.

In another embodiment, the raceway tube enclosing the electroluminescent strip may be attached directly to the flat surface of an egress doorframe side face. FIG. 6 depicts a cross-sectional view of a portion of an egress doorframe 80 with a flat surface side face 82 and raceway tube 84 attached thereto. The raceway tube is shown with mechanical fasteners 86 securing the tube to the side face 82. The raceway tube may also be attached without mechanical fasteners, using an adhesive. If an adhesive is used, the insertion points for the mechanical fasteners may be eliminated. In instances where the electroluminescent strip provides its own dielectric covering, it may be directly attached to the flat side face without a raceway tube. The raceway tube shown exhibits a bulbous curvature around the electroluminescent strip; however, a covering of any other shape is not prohibited, and would be as effective, provided the raceway tube's front surface is made of transparent or translucent material.

Figure 7:
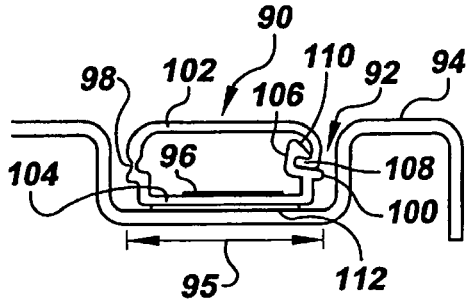
FIG. 7 depicts a cross-sectional view of a raceway tube.

A cross-sectional view of the preferred embodiment of the raceway tube 90 is depicted in FIG. 7. The raceway tube is shown inserted within a U-shaped channel 92 that is integrally formed with an egress doorframe side face 94. Although an integrally formed U-shaped channel has been depicted, other channel embodiments described above may be employed with the raceway tube. Similarly, the raceway tube as shown may be attached to a flat surface side face. For illustrative purposes, only the attachment to a centered U-shaped channel embodiment is described herein, notwithstanding the general applicability to the other embodiments. The raceway tube 90 shown is substantially rectangular, having a width 95 that allows it to be inserted fully within the U-shaped channel 92. The height of the raceway tube may vary; the raceway tube may be recessed, flush, or extend past the egress doorframe side face. The raceway tube requires an opening for inserting and securing the electroluminescent strip 96. In the preferred embodiment, the opening is made along the elongated direction of the raceway tube, perpendicular to the cross-sectional direction shown. Other openings are possible, provided enough access is allowed for inserting and securing the electroluminescence strip. In the preferred embodiment, the raceway tube forms a hinge 98 at one side, and an interlocking clamp 100 at the opposite side. Alternatively a two-part raceway may be utilized having overlapping, interlocking clamps on both side portions. The raceway tube is predominantly of uniform thickness except at the hinge, where a smaller thickness allows for the top portion of the raceway tube 102 to rotate about the hinge without detaching from the bottom portion of the raceway tube 104. The raceway tube is preferably made of flexible, transparent or translucent material having an elasticity that will accommodate the bending and flexing nature of the described hinge. The interlocking clamp 100 includes a C-shaped locking mechanism 106 on the side portion of the raceway tube opposite hinge 98, and a curved lip segment 108 that terminates at the edge of the top portion 110 of the C-shaped locking mechanism. The C-shaped locking mechanism 106 includes at least one angled segment 110 for facilitating sliding the curved lip segment 108 over the locking mechanism when initiating a locked position. The electroluminescent strip 96 may be secured by adhesive fastener, mechanical fastener, or by a friction fit. The raceway tube 90 may be secured in a similar manner. An adhesive fastener 112 is shown as an example.

Figure 8:
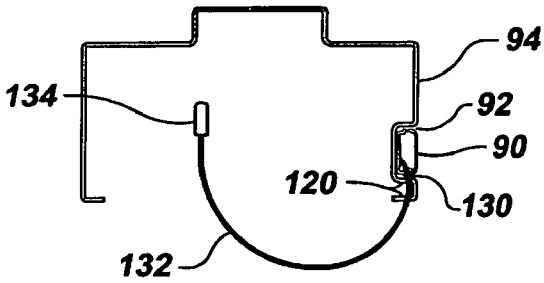
FIG. 8 depicts a cross-sectional view of the egress doorframe of FIG. 7 with the U-shaped channel and raceway tube shown with apertures to allow electrical wiring to traverse to and from the electroluminescent strip.

FIG. 8 depicts a cross-sectional view of the egress doorframe of FIG. 7 with the U-shaped channel 92 and raceway tube 90 shown with apertures 120, 130 respectively, to allow electrical wiring to traverse to and from the electroluminescent strip. Apertures 120 are formed within the outside portion of egress doorframe side face 94. Aperture 130 allows electrical wiring to enter and exit the raceway tube 90. Wiring 132 is shown terminated with an electrical plug connector 134 for attachment to a power source (not shown) or another electroluminescent strip (not shown).

Figure 9:
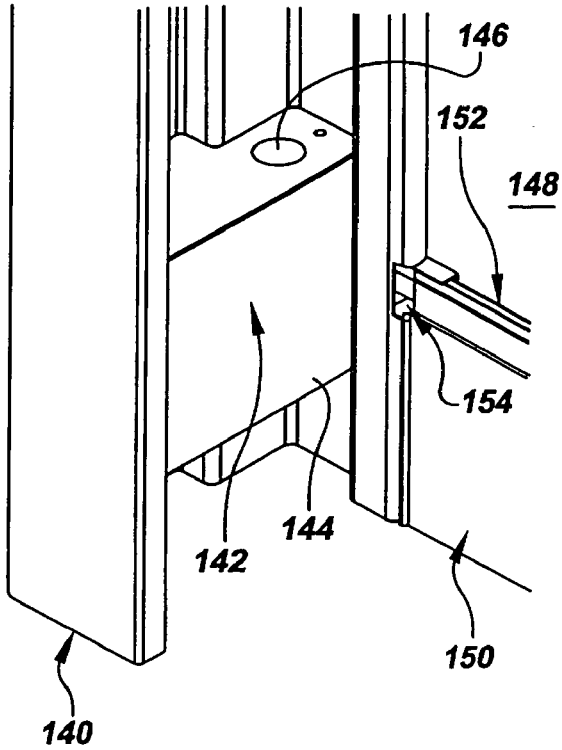
FIG. 9 depicts a partial internal view of an egress doorframe frame member having an integral channel, and a junction box attached thereto.

In order to provide electrical protection and meet typical electrical code requirements for wiring safety, the egress doorframe may be provided with junction boxes securable to the interior of the egress doorframe. FIG. 9 depicts a partial internal view of an egress doorframe frame member 140 having an integral U-shaped channel, and an electrical junction box 142 attached thereto. The junction box has a metal cover 144 and at least one knockout access port 146 for access to internal wiring. The junction box 142 provides electrical and safety shielding for the wiring to the electroluminescent strip. In this example, the egress doorframe is attached to a wall structure (not shown) having a baseboard 150. An electroluminescent strip within a raceway 152 traverses parallel to the baseboard 150. The wiring traverses through the egress doorframe aperture 154 to the electroluminescent strip within the raceway 152.

Figure 10:
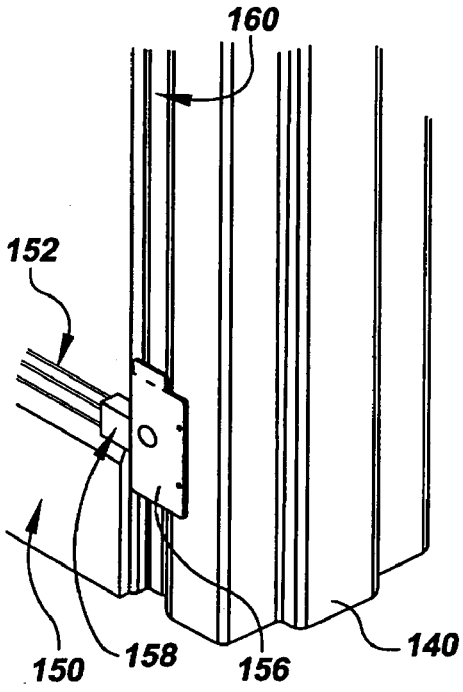
FIG. 10 depicts the outside of the egress doorframe frame member of FIG. 9 with a metal cover box attached in a drywall type construction.
Figure 11:
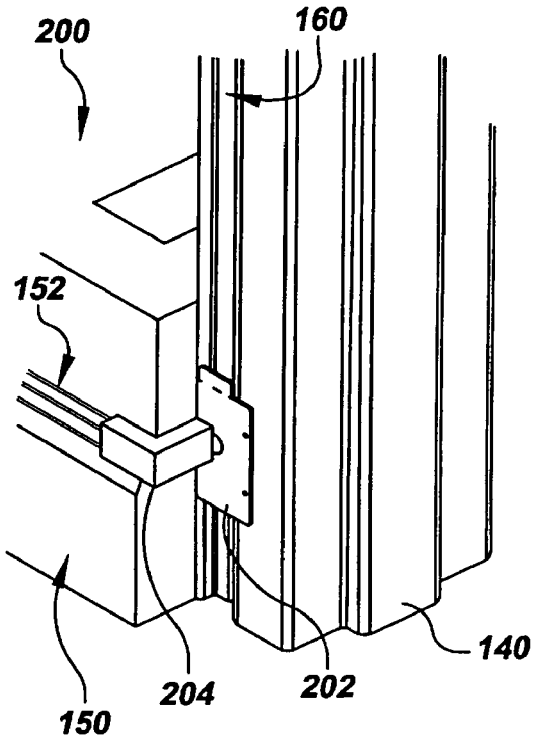
FIG. 11 depicts the outside of the egress doorframe frame member of FIG. 9 with a metal cover box attached in a masonry type construction.

FIGS. 10 and 11 provide a partial external view of the egress doorframe of FIG. 9 with connectors for two different wall structures, drywall and masonry, respectively. As shown in FIG. 10, the outside of egress doorframe frame member 140 is illustrated with a metal cover box 156 attached in a drywall type construction. The metal cover box 156 includes a raceway connector 158, formed to fit the raceway tube 152. The connector is preferably a molded connector. The raceway connector 158 is shown extending straight out from the metal cover box, and perpendicular to the recessed electroluminescent strip located within the vertical raceway tube 160. The raceway connector 158 connects to a raceway tube 152, which runs parallel with the baseboard 150. The metal cover box is attachable by adhesive fasteners, mechanical fasteners, or by friction fit. Preferably, mechanical fasteners are employed.

FIG. 11 depicts the outside of the egress doorframe frame member of FIG. 9 with a metal cover box 202 attached in a masonry type construction. The hollow egress doorframe 140 is shown attached to a masonry wall 200. The metal cover box 202 is connected to a formed L-shaped connector 204 to connect the electrical wiring from the electroluminescent strip within the raceway tube 160, recessed in the U-shaped channel of the egress doorframe, to the electroluminescent strip within raceway tube 152 attached to the wall structure and traversing parallel with the baseboard 150. The L-shaped connector 204 allows the electrical connection to remain shielded and protected as it is directed at a 90° angle by the connector.

Two metal covers are described above with attached connectors as illustrative examples of the types of connectors that may be used in the art. The connectors may be designed to mate with the raceway tube, and as such, would require dimensions that allow the raceway tube to partially insert within the connector or vice versa. Other shaped connectors, apart from a straight connector and an L-shaped connector, are employable in the current design, and the design is not limited by the connector shape.

Figure 12:
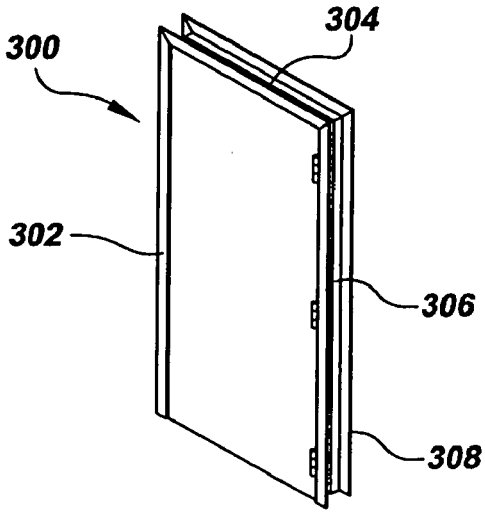
FIG. 12 depicts a bypass doorframe of the present invention.

A second element of the lighting system is a bypass doorframe. The bypass doorframe is used to reroute the wiring to the electroluminescent strips that are used for illuminating a wall, corridor, footpath, or other pathway towards a point of egress. Non-exit doorways defined by the bypass doorframes must not be illuminated, but must continue the electrical path for the electroluminescent strips abutting the bypass doorframe on either side. FIG. 12 depicts a bypass doorframe 300 of the present invention. The bypass doorframe 300 includes at least three frame members: two side panels 302, 306 and an overhead lintel 304.

The bypass doorframe is formed of hollow construction, having a formed interior portion for receiving a door. A metal channel raceway 308 is formed along the outer periphery of each frame member of the bypass doorframe.

Figure 13:
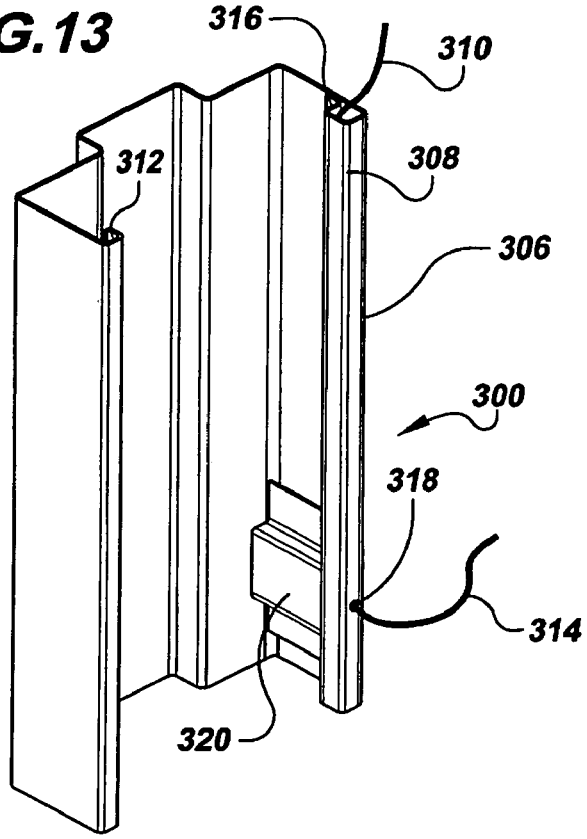
FIG. 13 depicts an expanded partial view of the bypass doorframe of FIG. 12.

FIG. 13 gives an expanded partial view of the bypass doorframe 300 of FIG. 12 showing the metal channel raceway 308. The metal channel raceway is formed to enclose wiring 310 that is routed within the channel, up one side panel, across the overhead lintel, and down the other side panel where the wiring exits the bypass doorframe. Preferably, the metal raceway channel is made to accommodate 22 gauge minimum insulated, stranded wire 314, although other sized metal raceway channels may also be acceptable without altering the intent or applicability of the present invention. In the preferred embodiment, a typical hollow construction doorframe has U-shaped terminations 312 at each end abutting a wall structure (not shown). The present invention allows for an elongated, flat metal L-shaped segment 316, secured to a U-shaped termination 312 of each frame member of the bypass doorframe by mechanical or adhesive fasteners, to enclose the rerouted wires 310. Apertures 318 allow the wiring to continue the electrical connections from one side of the bypass doorframe to the other. Additionally, as described for the wiring shielding and protection in the egress doorframe, a metal cover box 320 is provided within the bypass doorframe. The metal cover box is secured within the hollow construction of each side panel of the bypass doorframe, giving access to the wires. The box within the frame eliminates costly field installation of external junction boxes. The wiring 310 within the metal raceway channel allows the continuous baseboard lighting to be connected after the frame is installed.

A third element of the lighting system includes a plurality of electroluminescent strips within transparent or translucent raceway tubes that are attachable to structures that lead to the egress and bypass doorframes. These electroluminescent strips are those traversing along a drywall or masonry wall to a point of egress. They may be rerouted around a doorway that is not a point of egress by a bypass doorframe. In this case, an electroluminescent strip abuts the bypass doorframe at one side, continues its electrical connection via wires traversing through the bypass doorframe metal raceway channel, and connects on the other side of the bypass doorframe to another electroluminescent strip.

Figure 14C:
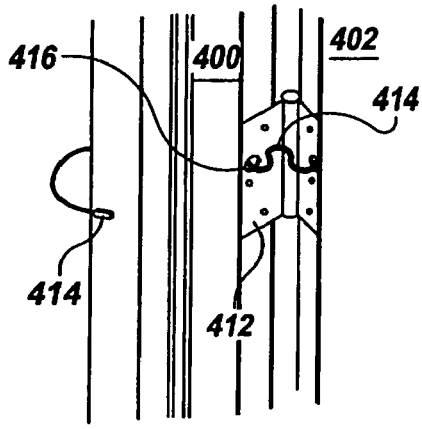
FIGS. 14A–14C depict various aspects of the egress doorframe exit door.
Figure 14A:
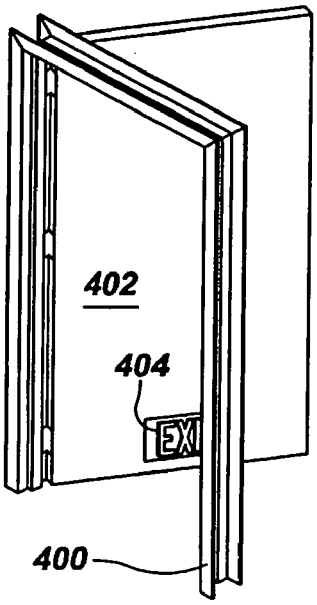
Figure 14B:
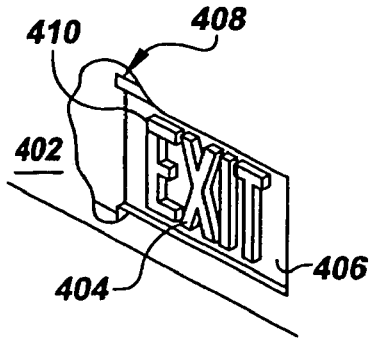

The door connected to the egress doorframe may be designed to have an EXIT sign located at the lower portion of the door to provide visibility to the egress point during times of smoke and high heat. FIG. 14 depicts various aspects of the egress doorframe exit door. FIG. 14A shows an elevated angled view of the egress doorframe 400 with exit door 402 attached. EXIT sign 404 is located in the lower center of the door 402. As shown in FIG. 14B, the door 402 includes a recessed area 406 for flush mounting the EXIT sign 404. If necessitated for structural integrity, there may be mechanical reinforcing 408 for the flush mounting of the EXIT sign. Electrical wiring for the sign 410 would traverse within the door and through an electrical hinge connector that would carry the wire to the egress doorframe. FIG. 14C depicts an electrical hinge 412 with wire 414 extending from the hinge, through the egress doorframe. A corresponding aperture within the doorframe at the hinge location accommodates the routing of this wire. As seen in FIG. 14C, discrete apertures 416 are disposed on the edge of the door 402 and egress doorframe 400 for the electroluminescent sign wire access. Power to the electroluminescent EXIT signage may be inverted from a power source of 12 volt DC, 24 volt DC, 110 to 120 volt AC, and the like.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A lighting system for illuminating a point of egress comprising:

an egress doorframe including egress side frame members and an egress overhead lintel, each having an outwardly facing U-shaped channel attached to, or integrally formed with, said side frame members and said egress overhead lintel, for mounting electroluminescent strips about the periphery of said egress doorframe such that when said electroluminescent strip in said U-shaped channel is activated by a power source, said egress doorframe is lighted peripherally about said frame members and said egress overhead lintel;

a plurality of electroluminescent strips within a first set of transparent or translucent raceway tube segments attachable to structures leading to said egress doorframe; and a bypass doorframe including bypass side frame members and a bypass overhead lintel, each having metal channel raceways inside for receiving electrical wiring, said channel raceways carrying said electrical wiring in from an aperture through one of said bypass frame members through said bypass overhead lintel and out an aperture of another of said bypass frame members;

such that when said power source is applied, said electroluminescent strips illuminate a path on said structures leading to said egress doorframe, said egress doorframe periphery is illuminated, and doorways not providing egress are configured with said bypass doorframes to maintain electrical continuity for said electroluminescent strips on each side of said doorways.

2. The lighting system of claim 1 further including a second set of transparent or translucent raceway tube segments for insertion within said outwardly facing U-shaped channel, said second set of raceway tube segments having said electroluminescent strips secured therein.

3. An egress doorframe for illuminating a point of egress, comprising:

at least three frame members including two side panels and an overhead lintel, said side panels separated by said overhead lintel, each of said frame members formed of a hollow construction, having a formed interior portion for receiving a door, an open exterior portion for attaching to a support structure, outwardly facing first and second side faces, and defining a maximum outer periphery; and an outwardly open electroluminescent strip in a channel located on or within said first side face substantially traversing said maximum outer periphery, such that when said electroluminescent strip is activated by a power source, said egress doorframe is lighted about said maximum outer periphery of said two side panels and said overhead lintel.

4. The egress doorframe of claim 3 including a U-shaped channel integrally formed with said first side face.

5. The egress doorframe of claim 3 further comprising a U-shaped channel secured to said first side face.

6. The egress doorframe of claim 3 wherein said electroluminescent strip is placed within a raceway tube having at least a transparent or translucent front surface, said raceway tube secured to said first side face.

7. The egress doorframe of claim 3 wherein said electroluminescent strip is placed within a raceway tube having at least a transparent or translucent front surface, said raceway tube fitted within and secured to said channel.

8. The egress doorframe of claim 3 further comprising a door attached to said doorframe by a hinged connector, said door having a recess for flush mounting an EXIT sign.

9. The egress doorframe of claim 3 further including a junction box securable to said doorframe, said junction box providing for electrical connection to said power source for said electroluminescent strips within said frame members.

10. The egress doorframe of claim 9 including an aperture within said doorframe where said junction box attaches to allow electrical connection from a connector in said junction box cover through said doorframe to said electroluminescent strips.

11. An egress doorframe for illuminating a point of egress, comprising at least three frame members including two side panels and an overhead lintel, said side panels separated by said overhead lintel, each of said frame members formed of a hollow construction, having a formed interior portion for receiving a door, an open exterior portion for attaching to a support structure, outwardly facing first and second side faces, and defining a maximum outer periphery, and an outwardly open electroluminescent strip secured to said first side face within said maximum outer periphery, wherein said electroluminescent strip is placed within a raceway tube having at least a transparent or translucent front surface, said raceway tube secured to said first side face, wherein said raceway tube comprises a substantially rectangular shape having a front portion, a back portion, and two side portions, said raceway tube being substantially uniform in thickness on said front and back portions, having a thickness substantially smaller than said uniform thickness on one of said side portions forming a hinge, and having an overlapping, interlocking clamp on the other of said side portions, such that when said electroluminescent strip is activated by a power source, said egress doorframe is lighted about said two side panels and said overhead lintel.

12. An egress doorframe for illuminating a point of egress, comprising at least three frame members including two side panels and an overhead lintel, said side panels separated by said overhead lintel, each of said frame members formed of a hollow construction, having a formed interior portion for receiving a door, an open exterior portion for attaching to a support structure, outwardly facing first and second side faces, having a channel located on said first side face, and defining a maximum outer periphery, and an outwardly open electroluminescent strip secured to said first side face within said maximum outer periphery, wherein said electroluminescent strip is placed within a raceway tube having at least a transparent or translucent front surface, said raceway tube fitted within and secured to said channel, wherein said raceway tube comprises a substantially rectangular shape having a front portion, a back portion, and two side portions, said raceway tube being substantially uniform in thickness on said front and back portions, having a thickness substantially smaller than said uniform thickness on one of said side portions forming a hinge, and having an overlapping, interlocking clamp on the other of said side portions, or overlapping, interlocking clamps on both side portions of a two part raceway tube, such that when said electroluminescent strip is activated by a power source, said egress doorframe is lighted about said two side panels and said overhead lintel.

13. An egress doorframe for illuminating a point of egress, comprising:

at least three frame members including two side panels and an overhead lintel, said side panels separated by said overhead lintel, each of said frame members formed of a hollow construction, having a formed interior portion for receiving a door, an open exterior portion for attaching to a support structure, outwardly facing first and second side faces, and defining a maximum outer periphery, and an outwardly open electroluminescent strip secured to said first side face within said maximum outer periphery;

a door attached to said doorframe by a hinged connector, said door having a recess for flush mounting an EXIT sign, said hinged connector having at least one aperture for electrical wiring to and from said EXIT sign through said door and said recess; and a corresponding aperture in said doorframe to receive said wiring from said hinged connector;

such that when said electroluminescent strip is activated by a power source, said egress doorframe is lighted about said two side panels and said overhead lintel.

14. An egress doorframe for illuminating a point of egress, comprising:

at least three frame members including two side panels and an overhead lintel, said side panels separated by said overhead lintel, each of said frame members formed of a hollow construction, having a formed interior portion for receiving a door, an open exterior portion for attaching to a support structure, outwardly facing first and second side faces, and defining a maximum outer periphery;

an outwardly open electroluminescent strip in a channel located on or within said first side face substantially traversing said maximum outer periphery, such that when said electroluminescent strip is activated by a power source, said egress doorframe is lighted about said maximum outer periphery of said two side panels and said overhead lintel; and a raceway tube having at least a transparent or translucent front surface, and secured to said first side face, comprising a substantially rectangular shape having a front portion, a back portion, and two side portions, said raceway tube being substantially uniform in thickness on said front and back portions, having a thickness substantially smaller than said uniform thickness on one of said side portions forming a hinge, and having an overlapping, interlocking clamp on the other of said side portions, such that said electroluminescent strip is placed in said raceway tube.

15. An egress doorframe for illuminating a point of egress, comprising:

at least three frame members including two side panels and an overhead lintel, said side panels separated by said overhead lintel, each of said frame members formed of a hollow construction, having a formed interior portion for receiving a door, an open exterior portion for attaching to a support structure, outwardly facing first and second side faces, and defining a maximum outer periphery;

an outwardly open electroluminescent strip in a channel located on or within said first side face substantially traversing said maximum outer periphery, such that when said electroluminescent strip is activated by a power source, said egress doorframe is lighted about said maximum outer periphery of said two side panels and said overhead lintel; and a raceway tubing having at least a transparent or translucent front surface, said raceway tube fitted within and secured to said channel, and comprising a substantially rectangular shape having a front portion, a back portion, and two side portions, said raceway tube being substantially uniform in thickness on said front and back portions, having a thickness substantially smaller than said uniform thickness on one of said side portions forming a hinge, and having an overlapping, interlocking clamp on the other of said side portions, or overlapping, interlocking clamps on both side portions of a two part raceway tube, such that said electroluminescent strip is placed within said raceway tubing.

16. An egress doorframe for illuminating a point of egress, comprising:

at least three frame members including two side panels and an overhead lintel, said side panels separated by said overhead lintel, each of said frame members formed of a hollow construction, having a formed interior portion for receiving a door, an open exterior portion for attaching to a support structure, outwardly facing first and second side faces, and defining a maximum outer periphery;

an outwardly open electroluminescent strip in a channel located on or within said first side face substantially traversing said maximum outer periphery, such that when said electroluminescent strip is activated by a power source, said egress doorframe is lighted about said maximum outer periphery of said two side panels and said overhead lintel;

a door attached to said doorframe by a hinged connector, said door having a recess for flush mounting an EXIT sign, said hinged connector comprising at least one aperture for electrical wiring to and from said EXIT sign through said door and said recess; and a corresponding aperture in said doorframe to receive said wiring from said hinged connector.

* * * * *